US005579904A

United States Patent [19]

Holley, Jr.

[11] Patent Number: 5,579,904

[45] Date of Patent: Dec. 3, 1996

[54] BASKET-STYLE CARRIER WITH REINFORCED HANDLE

[75] Inventor: John M. Holley, Jr., Lawrenceville, Ga.

[73] Assignee: The Mead Corporation, Dayton, Ohio

[21] Appl. No.: 508,692

[22] Filed: Jul. 28, 1995

[51] Int. Cl.[6] ..... B65D 75/00

[52] U.S. Cl. ..... 206/180; 206/187; 206/162

[58] Field of Search ..... 206/162, 187, 206/190, 180, 428, 188, 142

[56] References Cited

U.S. PATENT DOCUMENTS

| | | | |
|---|---|---|---|
| 3,917,060 | 11/1975 | Wood | 206/187 |
| 4,010,847 | 3/1977 | Wood et al. | 206/187 |
| 4,187,944 | 3/1979 | Wood | 206/187 |
| 4,319,682 | 3/1982 | Wright et al. | 206/180 |
| 4,927,009 | 5/1990 | Stout | 206/186 |

*Primary Examiner*—David T. Fidei

*Attorney, Agent, or Firm*—Thomas A. Boshinski

[57] ABSTRACT

A carrier for a plurality of objects arranged in at least two rows includes a reinforced handle and is formed from first and second side walls, first and second end walls interconnecting the side walls, and a medial panel extending between and connected to the first and second end walls, the medial panel being disposed between the first and second side walls. A primary bottom wall is connected and extends between lower portions of the first and second side walls. The handle includes a handle opening defined in the medial panel, first and second outer handle panels foldably connected at a first end edge thereof to a side edge of the medial panel and extending across the medial panel, and first and second handle reinforcing panels foldably connected at a first end edge thereof to second end edges of the first and second outer handle panels, respectively, and extending across the medial panel. First and second handle reinforcing tabs are foldably connected at a first end edge thereof to second end edges of the first and second handle reinforcing panels, respectively.

4 Claims, 8 Drawing Sheets

BASKET-STYLE CARRIER WITH REINFORCED HANDLE

BACKGROUND OF THE INVENTION

The present invention relates generally to paperboard carriers for articles such as beverage bottles. More particularly, it relates to a basket-style carrier in which the handle is reinforced to help prevent tearing of the carrier when lifted and/or carried.

One traditional paperboard carrier for articles such as beverage bottles is the basket-style carrier. An example of such a carrier is shown in U.S. Pat. No. 4,927,009. The carrier includes side, end and bottom walls, and is typically used with articles grouped in two rows. Located between the two rows is a medial panel which connects the end walls and includes an opening to provide a handle by which the basket may be carried. In its usual form, this carrier also includes partition panels extending between the medial panel and the side walls, to define individual cells into which the articles may be placed.

Great stress can be placed upon the paperboard comprising the carrier when a loaded carrier is lifted and/or carried, This can result in tearing of the carrier and its possible failure. As a result, a number of techniques for handle reinforcement have been developed. Examples can be seen from U.S. Pat. Nos. 4,010,847 and 4,187,944.

Ideally, the handle reinforcement structure should not only be effective for its reinforcement purpose, but should also add little to the paperboard requirements for the carrier and should not complicate the carton manufacturing process, Despite the foregoing efforts to develop a carrier with a reinforced handle, a need for such a carrier still exists.

SUMMARY OF THE INVENTION

The present invention provides a carrier for a plurality of objects arranged in at least two rows. The carrier includes a reinforced handle and comprises substantially parallel first and second side walls, substantially parallel first and second end walls interconnecting the side walls, and a medial panel extending between and connected to the first and second end walls, the medial panel being disposed between and substantially parallel to the first and second side walls. A primary bottom wall is connected and extends between lower portions of the first and second side walls.

A handle for the carrier comprises a handle opening defined in the medial panel, first and second outer handle panels foldably connected at a first end edge thereof to a side edge of the medial panel and extending across the medial panel, and first and second handle reinforcing panels foldably connected at a first end edge thereof to second end edges of the first and second outer handle panels, respectively, and extending across the medial panel. First and second handle reinforcing tabs are foldably connected at a first end edge thereof to second end edges of the first and second handle reinforcing panels, respectively.

The first end edges of the outer handle panels and the first end edges of the reinforcing tabs may be substantially coincident, wherein the first end edges of the reinforcing tabs extend downwardly along the first side edge of the medial panel further than the first end edges of the outer handle panels.

The first end edges of the outer handle panels and the second end edges of the handle reinforcing panels may be substantially coincident, wherein the second end edges of the handle reinforcing panels extend downwardly along the first side edge of the medial panel further than the first end edges of the outer handle panels.

Further, the first end edges of the reinforcing tabs and the second end edges of the handle reinforcing panels may be connected respectively along a pair of reinforcing fold lines, and the first end edges of the outer handle panels and the reinforcing fold lines may be substantially coincident, wherein the reinforcing fold lines extend downwardly along the first side edge of the medial panel further than the first end edges of the outer handle panels.

DETAILED DESCRIPTION OF THE PREFERRED EMBODIMENT

Figure 1:
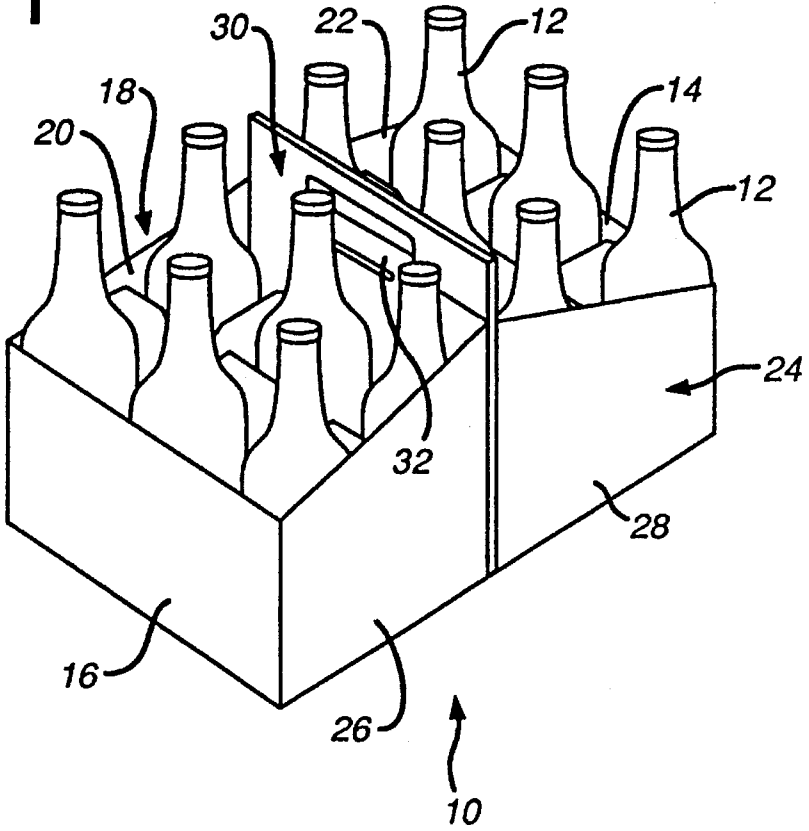
FIG. 1 is a perspective view of a carrier in accordance with a preferred embodiment of the present invention, showing the carrier in set-up condition and with beverage bottles loaded therein.

Referring generally now to FIG. 1, the present invention provides an article carrier 10 for carrying articles such as beverage bottles 12. While the carrier 10 is described therein generally in connection with the carrying of beverage bottles 12, it will be recognized that the carrier is suitable for the carrying of other products, such as non-beverage products packaged in bottles, beverage and non-beverage products packaged in cans, and other liquid and non-liquid products.

Further, while the preferred embodiment described herein comprises a carrier for four rows of bottles 12, the invention is not limited to such a carrier and may be used with a more common, two-row basket carrier.

The carrier 10 includes a first side wall 14 and a second side wall 16. Connecting the side walls are a first end panel 18, formed of end panel 20 and end panel 22, and second end wall 24, formed of end panels 26 and 28. Extending between end walls 18 and 24, disposed between the second and third rows of bottles 12, is a medial panel 30. Medial panel 30 is provided near its upper end with an opening 32 that provides a handle by which the carrier 10 may be lifted.

Figure 2:
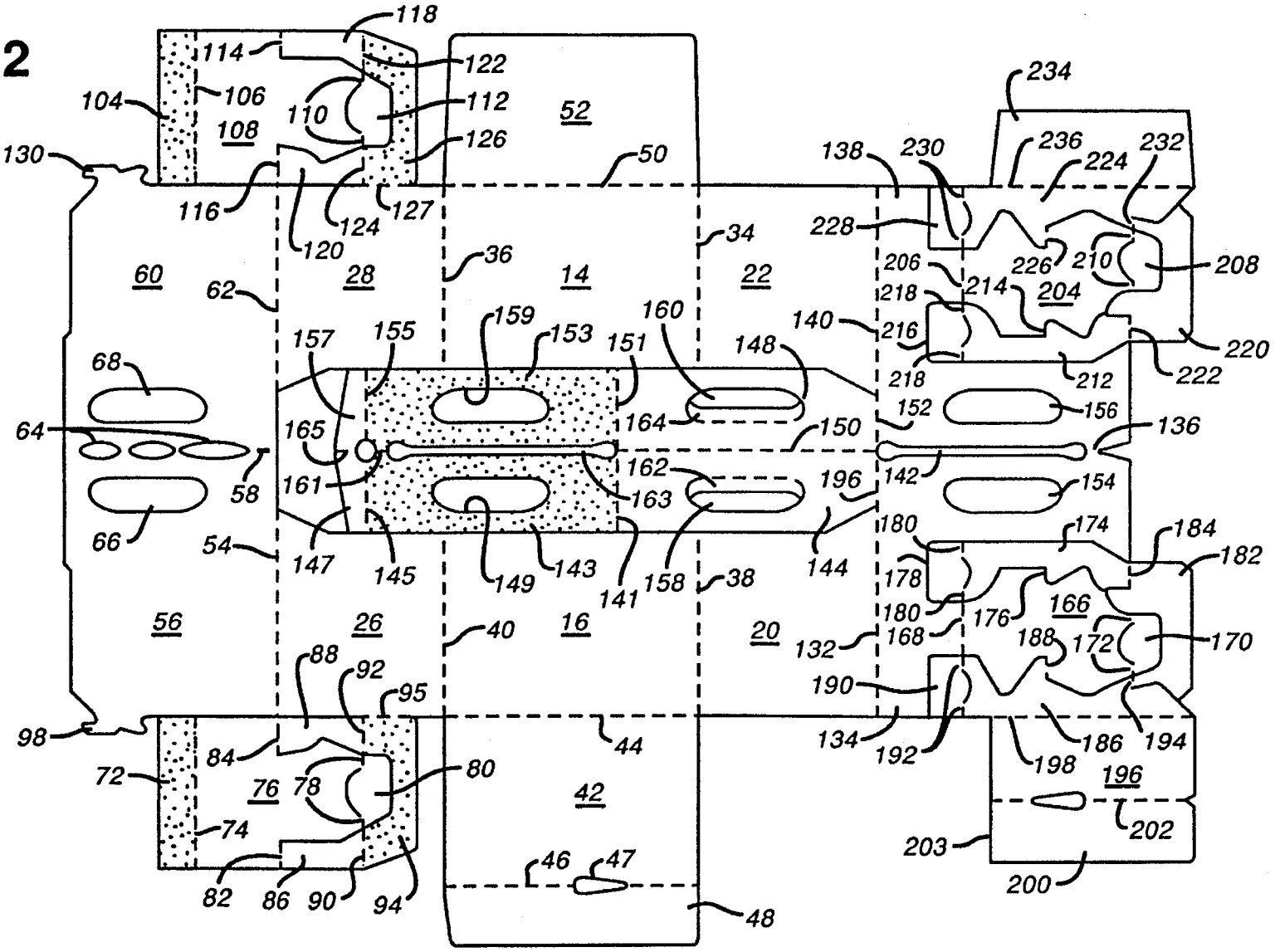
FIG. 2 is a plan view of a blank from which the carrier of FIG. 1 may be formed.

A blank from which the carrier 10 may be formed is shown in FIG. 2, the blank being shown with the inner surface visible. Side wall 14 is connected to end panel 22 along a fold line 34, and at an opposite end to end panel 28 along a fold line 36. Side wall 16 is connected at one end to end panel 20 along a fold line 38, and at an opposite end to end panel 26 along a fold line 40. Side wall 16 is also connected to primary bottom wall panel 42 along a fold line 44. Panel 42 is in turn connected along fold line 46 to a glue flap 48. Connected to side wall 14 along fold line 50 is primary bottom wall panel 52.

End panel 26 is connected along a fold line 54 to a medial panel 56. Medial panel 56 is connected along fold line 58 to a medial panel 60. Panel 60 is also connected to end panel 28 along a fold line 62. Fold line 58 includes a plurality of cutouts 64. Such cutouts 64 are included for relieving the accumulation of folded material during the folding and gluing of the blank, as is typical in the art. Additionally, medial panels 56 and 60 include openings 66 and 68, respectively, such openings cooperating to form a portion of the carton handle.

Disposed at the lower end of medial panel 56 is an attachment panel 72. Attachment panel 72 is connected by fold line 74 to a secondary partition panel 76. Partition panel 76 includes fold lines 78 which connect the outer end of partition panel 76 to an anchoring flap 80. Also, partition panel 76 is connected by fold lines 82 and 84 to primary partition straps 86 and 88, respectively. Straps 86 and 88 are connected by fold lines 90 and 92, respectively, to an anchoring flap 94. Anchoring flap 94 is connected along fold line 95 to end panel 26.

Formed along the lower edge of medial panel 56 is a hook 98 used in accordance with the present invention for retaining the carrier in an erected position. Hook 98 is described in greater detail herein.

Disposed at the lower end of medial panel 60 is an attachment panel 104. Attachment panel 104 is connected by fold line 106 to a secondary partition panel 108. Partition panel 108 includes fold lines 110 which connect the outer end of partition panel 108 to an anchoring flap 112. Also, partition panel 108 is connected by told lines 114 and 116 to primary partition straps 118 and 120, respectively. Straps 118 and 120 are connected by fold lines 122 and 124, respectively, to an anchoring flap 126. Anchoring flap 126 is connected along fold line 127 to the lower edge of end panel 28.

Formed along the lower edge of medial panel 60 is a hook 130 used in cooperation with hook 98 for retaining the carrier in an erected position as will be described in greater detail herein.

End panel 20 is connected along the fold line 132 to partial medial panel 134. Partial medial panel 134 is in turn connected along a fold line 136 to partial medial panel 138, which is also connected along fold line 140 to end panel 22. Disposed between partial medial panels 134 and 138 is a relief aperture 142 for relieving material during the folding of the blank into the completed carrier.

Also connected to partial medial panel 134 is outer handle panel 144, connected along fold line 146. Outer handle panel 144 is connected to a second outer handle panel 148 along fold line 150. Outer handle panel 148 is also connected to partial medial panel 138 along fold line 152. Outer handle panels 144 and 148 are disposed generally between, but are separated from, end panels 20 and 22.

Partial medial panels 134 and 138 are provided with apertures 154 and 156, respectively, which form a part of the handle for the completed carrier. Handle panels 144 and 148 are also provided with apertures 158 and 160, which form a portion of the handle, and further include cushioning flaps 162 and 164, respectively, which extend partially into the apertures 158 and 160, respectively, to cushion the hand of a person carrying the carrier by the handle.

Connected to outer handle panel 144 along fold line 141 is handle reinforcing panel 143, which is in turn connected along fold line 145 to handle reinforcing tab 147. Handle reinforcing panel 143 includes an aperture 149 that forms a part of the handle aperture for the completed carrier.

Connected to outer handle panel 148 along fold line 151 is handle reinforcing panel 153, which is in turn connected along fold line 155 to handle reinforcing tab 157. Handle reinforcing panel 153 includes an aperture 159 that forms a part of the handle aperture for the completed carrier.

Handle reinforcing panels 143 and 153 are connected to each other along a short fold line 161, and a relief aperture 163 is disposed between the panels 143 and 153. Handle reinforcing tabs 147 and 157 are connected by a fold line 165 and function in accordance with the present invention to reinforce the completed handle as will be described herein.

A secondary partition panel 166 is connected to partial medial panel 134 along fold line 168. An anchoring flap 170 is connected at the opposite end of secondary partition panel 166 by fold lines 172. An upper primary partition strap 174 is connected to secondary partition panel 166 along fold line 176. Strap 174 includes an anchoring flap 178 connected at one end along fold lines 180, and an anchoring panel 182 connected at an opposite end along fold line 184. A lower primary partition strap 186 is also connected to secondary partition panel 166 along fold line 188. Anchoring flap 190 is connected to strap 186 along fold lines 192, while the opposite end of strap 186 is connected to anchoring panel 182 along fold line 194.

A secondary bottom panel 196 is connected to the lower edge of primary partition strap 186 along fold line 198. Secondary bottom panel 200 is connected to bottom panel 196 along fold line 202, and an aperture 203 for cooperating with hooks 98 and 130, as described in detail herein, is disposed along fold line 202.

A secondary partition panel 204 is connected to partial medial panel 138 along fold line 206. An anchoring flap 208 is connected at the opposite end of secondary partition panel 204 by fold lines 210. An upper primary partition strap 212 is connected to secondary partition panel 204 along fold line 214. Strap 212 includes an anchoring flap 216 connected at one end along fold lines 218, and an anchoring panel 220 connected at an opposite end along fold line 222. A lower primary partition strap 224 is also connected to secondary partition panel 204 along fold line 226. Anchoring flap 228 is connected to strap 226 along fold lines 230, while the opposite end of strap 226 is connected to anchoring panel 220 along fold line 232.

A secondary bottom panel 234 is connected to the lower edge of primary partition strap 224 along fold line 236.

Figure 3:
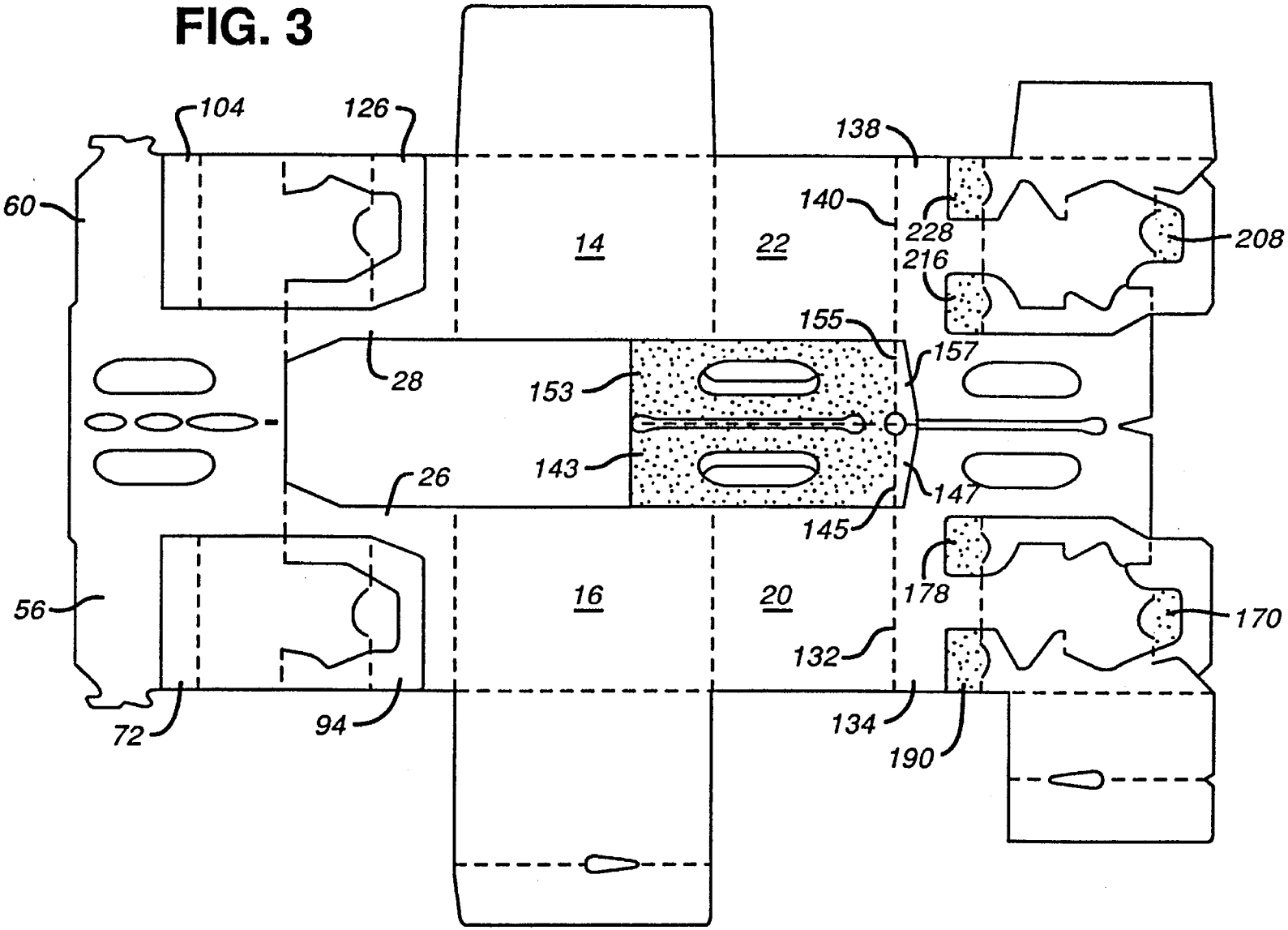
FIGS. 3–6 are a series of views showing the manner in which the blank of FIG. 2 may be folded to form the completed collapsed carrier.

To assemble the blank of FIG. 2 into the completed, collapsed carrier, glue is first applied to attachment panels 72 and 104 and anchoring flaps 94 and 126 as shown generally by cross hatching in FIG. 2. Attachment panel 72, secondary partition panel 76, straps 86 and 88 and anchoring flap 94 are then rotated along fold line 95 and positioned on medial panel 56 and end panel 26, as shown in FIG. 3. As a result of the glue which has been applied, attachment panel 72 is secured to medial panel 56, and anchoring flap 94 is secured to end panel 26.

Similarly, attachment panel 104, secondary partition panel 108, straps 118 and 120 and anchoring flap 126 are all pivoted about fold line 127 and placed in position on medial panel 60 and end panel 28 as shown in FIG. 3. Attachment panel 104 is thereby secured to medial panel 60, and anchoring flap 126 is secured to end panel 28.

Glue is also applied to handle reinforcement panels 143 and 153, which are then pivoted about fold lines 141 and 151 to position panels 143 and 153 on outer handle panels 144 and 148, respectively. This also positions handle reinforcing tabs 147 and 157 on partial medial panels 134 and 138 as shown in FIG. 3.

Figure 4:
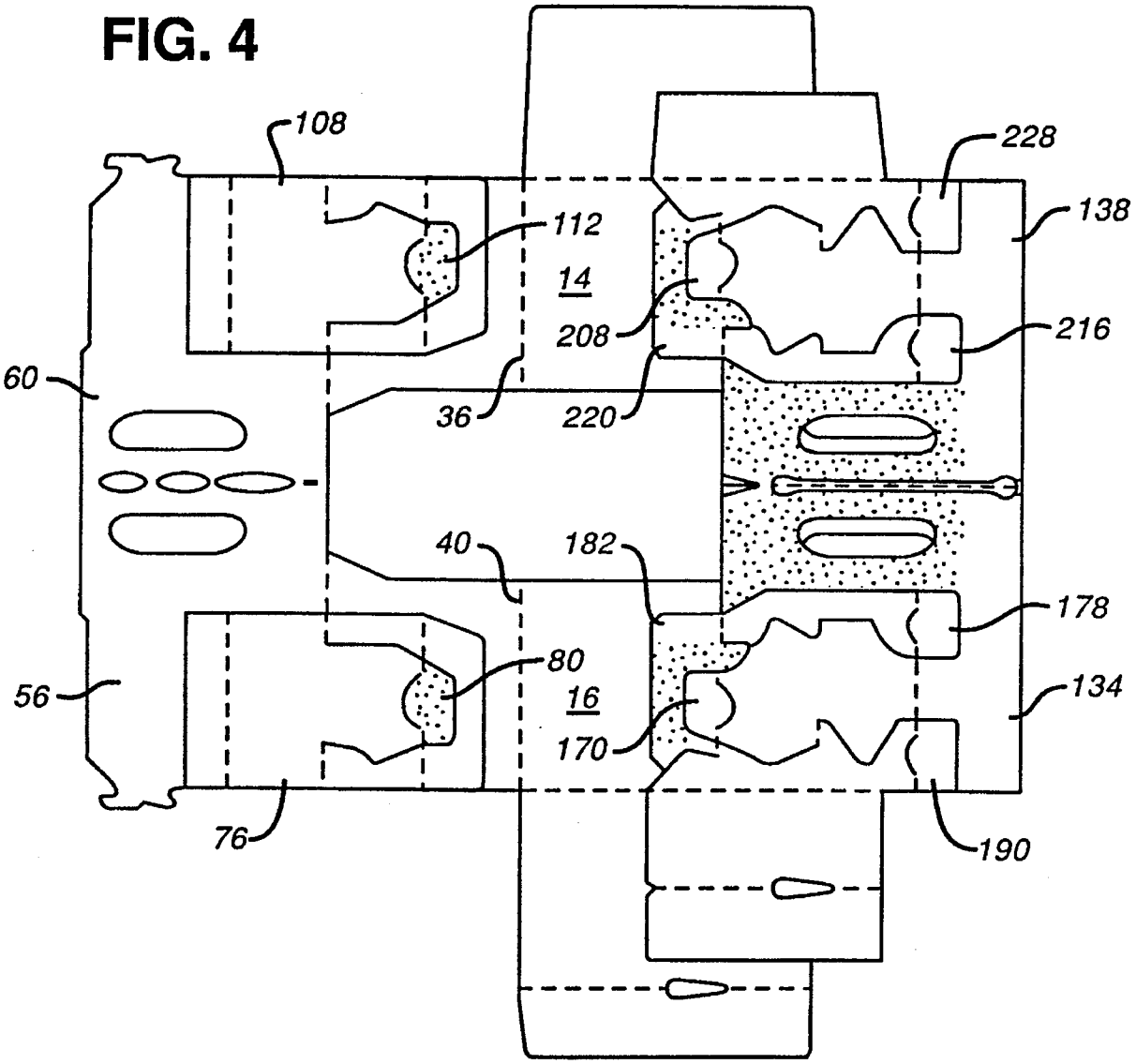

Continuing to refer to FIG. 3, glue is next applied to the opposite sides of handle reinforcing panels 143 and 153, and to anchoring flaps 170, 178, 190, 208, 216 and 228. The right hand portion of the blank as shown in FIG. 3, including partial medial panels 134 and 138, is pivoted about fold lines 132, 146, 152, 140, 145 and 155. The folded portion of the blank is then generally positioned on end panels 20 and 22 and partially on side panels 14 and 16, as shown in FIG. 4. Because of the glue previously applied, anchoring panel 170 is secured to side panel 16, anchoring panels 178 and 190 are secured to end panel 20, anchoring flap 208 is secured to side panel 14, and anchoring flaps 216 and 228 are secured to end panel 22.

For the next step in the folding and gluing of the blank, glue is applied to anchoring flaps 80 and 112 as shown in FIG. 4. Additionally, glue is applied to a portion of anchoring panels 182 and 220, and to partial medial panels 134 and 138 in the vicinity of apertures 154 and 156. After the application of glue, the left hand portion of the blank as shown in FIG. 4 is folded along fold lines 36 and 40, thereby folding end panels 26 and 28 and medial panels 56 and 60 into overlapping relationship with side panels 14 and 16 and partial medial panels 134 and 138. As a result of the glue previously applied, anchoring flap 80 is secured to side panel 16, while anchoring flap 112 is secured to side panel 14. Anchoring panel 182 is secured to a portion of secondary partition panel 76, and anchoring panel 220 is secured to a portion of secondary partition panel 108. Additionally, medial panels 56 and 60 are secured to partial medial panels 134 and 138, respectively. The partially completed carrier then appears as shown in FIG. 5.

Figure 5:
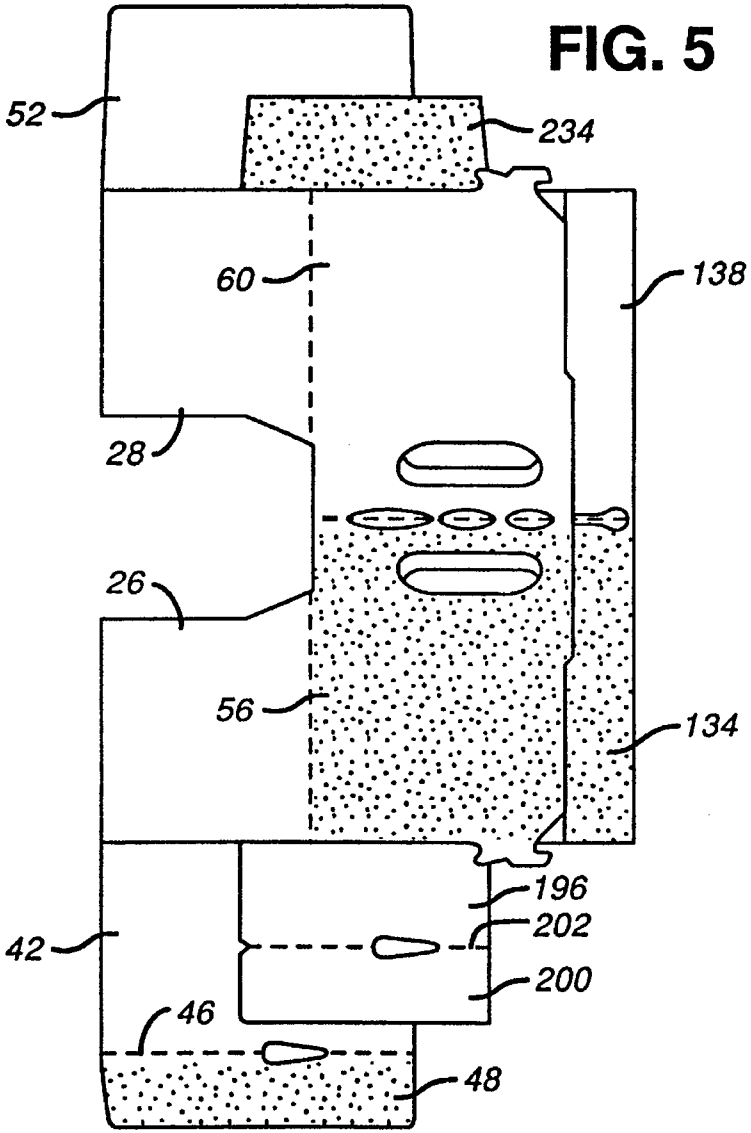

As the final step in the gluing and folding process, glue is applied as shown in FIG. 5 to medial panel 56 and partial medial panel 134. Glue is also applied to secondary bottom panel 234 and glue flap 48. The upper portion of the partially completed carton shown in FIG. 5 is then folded along fold line 58 to secure medial panel 60 to medial panel 56 and partial medial panel 138 to partial medial panel 134. Secondary bottom panel 200 is then folded along fold line 202 to secure bottom panel 200 to secondary bottom panel 234. Finally, glue flap 48 is folded along fold line 46 to secure primary bottom panel 52 to the outer surface of side panel 14.

Figure 6:
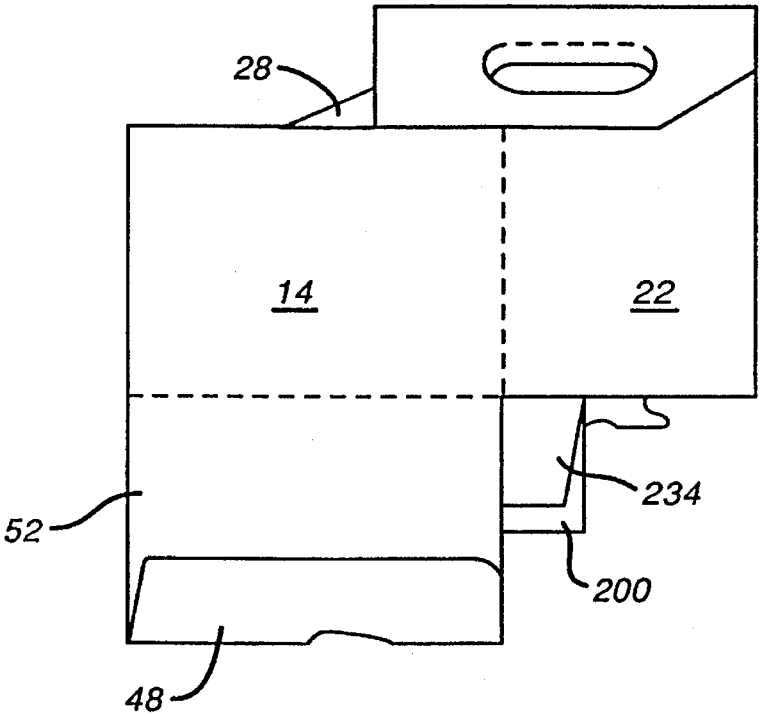

The completed and collapsed carton is shown in FIG. 6.

Figure 7:
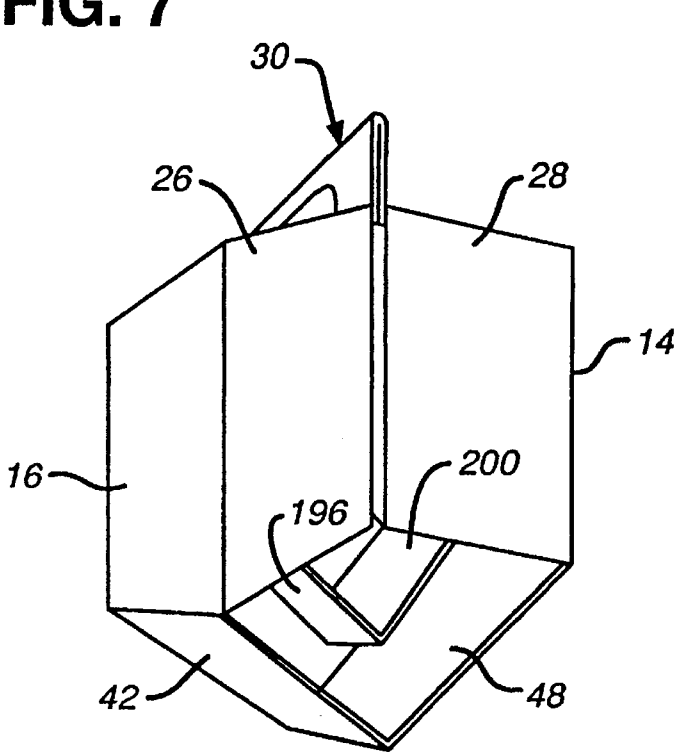
FIG. 7 is a perspective view of the carrier shown in an intermediate position during set up from a collapsed to erected carrier.

The carton may be erected as shown in FIG. 7. Side walls 14 and 16 are moved longitudinally with respect to the medial panel structure 30. As a result, end panels 20, 22, 26 and 28 are moved into position to form the end walls 18 and 24 as shown in FIG. 1. Such a method of erecting is typical of basket-style carriers of the prior art.

As shown in FIG. 7, however, the carrier of the present invention forms a double bottom structure. A primary bottom wall 235 is formed from primary bottom panels 42 and 48, connected to side walls 14 and 16. Panels 42 and 48 move into a planar relationship as the carton is erected, thereby forming the primary bottom wall.

In a similar manner, the secondary bottom wall 237 is formed from secondary bottom panels 196 and 200. These panels are connected to the primary partition structure (refer back, for example, to FIG. 2). Set up of the carrier causes panels 196 and 200 to move into a planar position, thereby creating a secondary bottom wall which extends between the primary partition structures. As a result, bottles or other articles which are loaded into the carton into the outermost rows will be positioned only on the primary bottom wall, on one of the panels 42 and 48. Bottles or other articles positioned on the innermost two rows will be supported by a double-ply bottom structure, and will be disposed on either panel 196 or 200, which will in turn be positioned in contact with panel 42 or 48, respectively.

Figure 8:
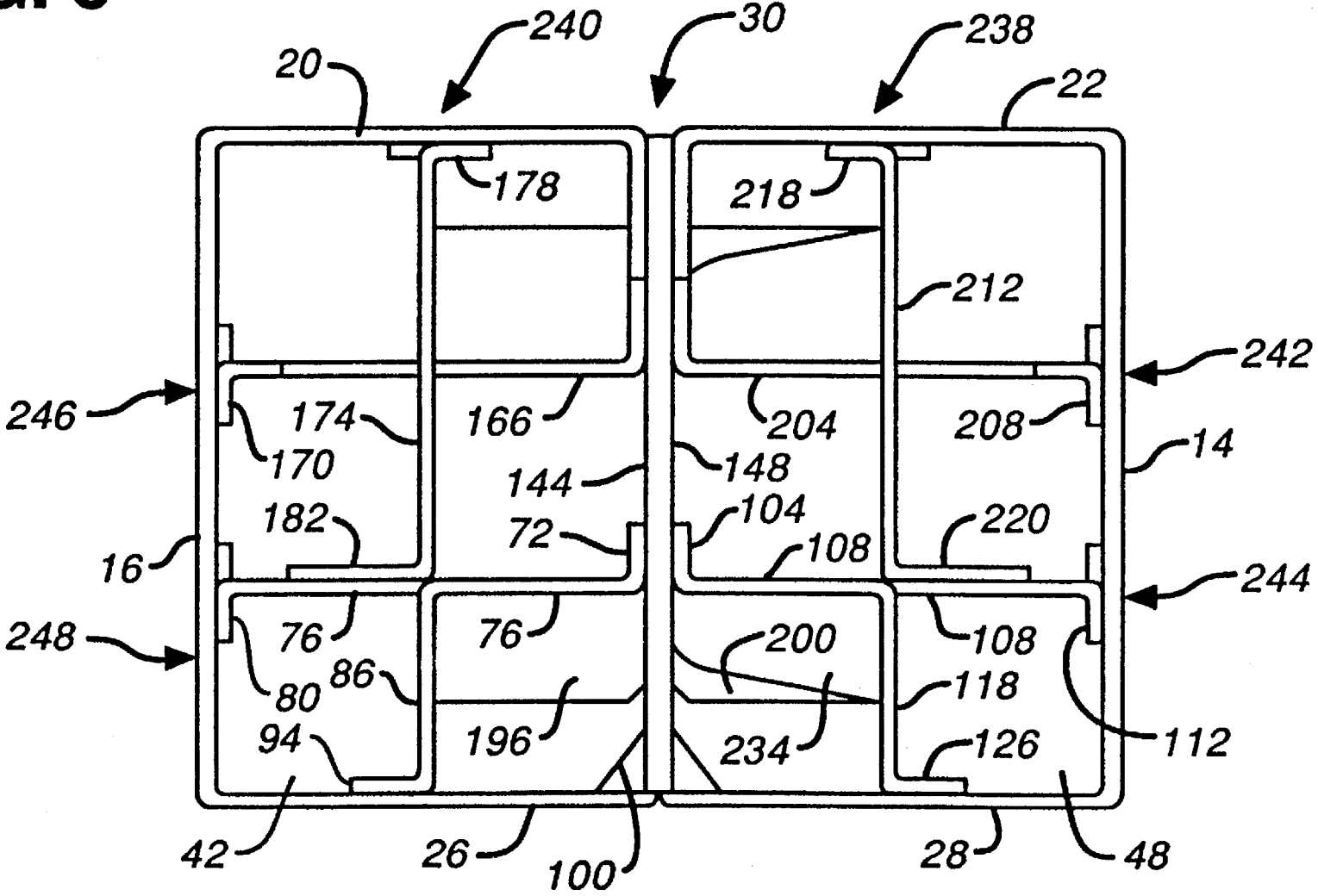
FIG. 8 is a top plan view of the carrier of FIG. 1, shown with the articles removed.

Further reference may be made to FIG. 8, which shows the erected carrier in top plan view. From FIG. 8, it can be seen that the first primary partition structure 238 is positioned between side wall 14 and medial panel structure 30, and is comprised of strap 212 (and strap 224, not shown) and strap 120 (and strap 118, not shown). A second primary partition structure 240 is disposed between medial panel structure 30 and side wall 16, and comprises strap 174 (and strap 186, not shown) and strap 86 (and strap 88, not shown). Secondary partition structure 242, comprised of secondary partition panel 204 and secondary partition structure 244, comprised of secondary partition panel 108, interconnects side wall 14, primary partition structure 238, and medial panel structure 30. Secondary partition structure 246, comprised of secondary partition panel 166, and secondary partition structure 248, comprised of secondary partition panel 76, interconnects side wall 16, primary partition structure 240 and medial partition structure 30. The primary and secondary partition structures together define a plurality of cells for receiving the bottles or other articles to be packaged within the carrier.

Figure 9:
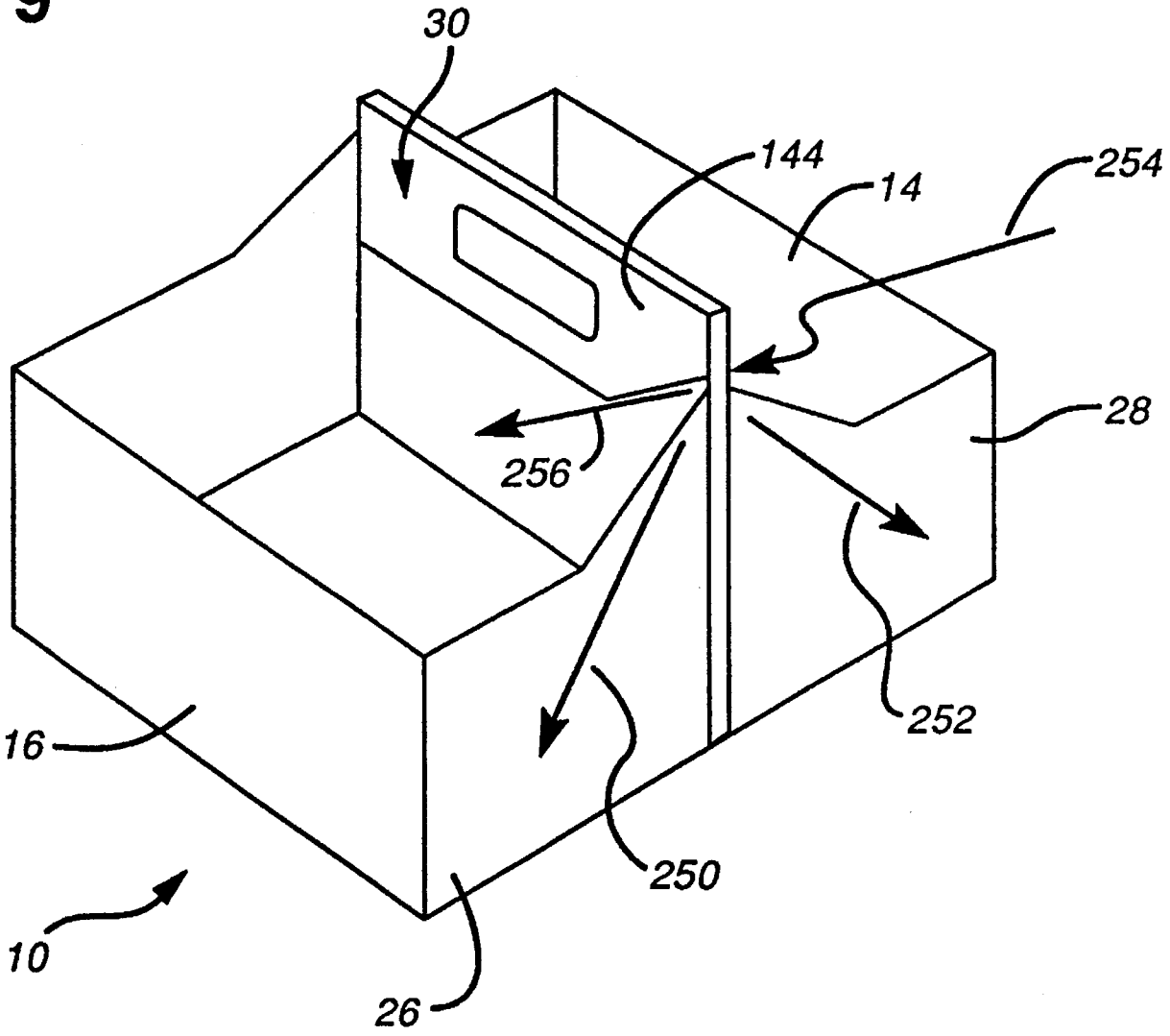
FIG. 9 is a perspective view of an erected carrier showing the bottles and partition structure removed, illustrating stresses on the carrier during lifting and/or carrying.
Figure 10:
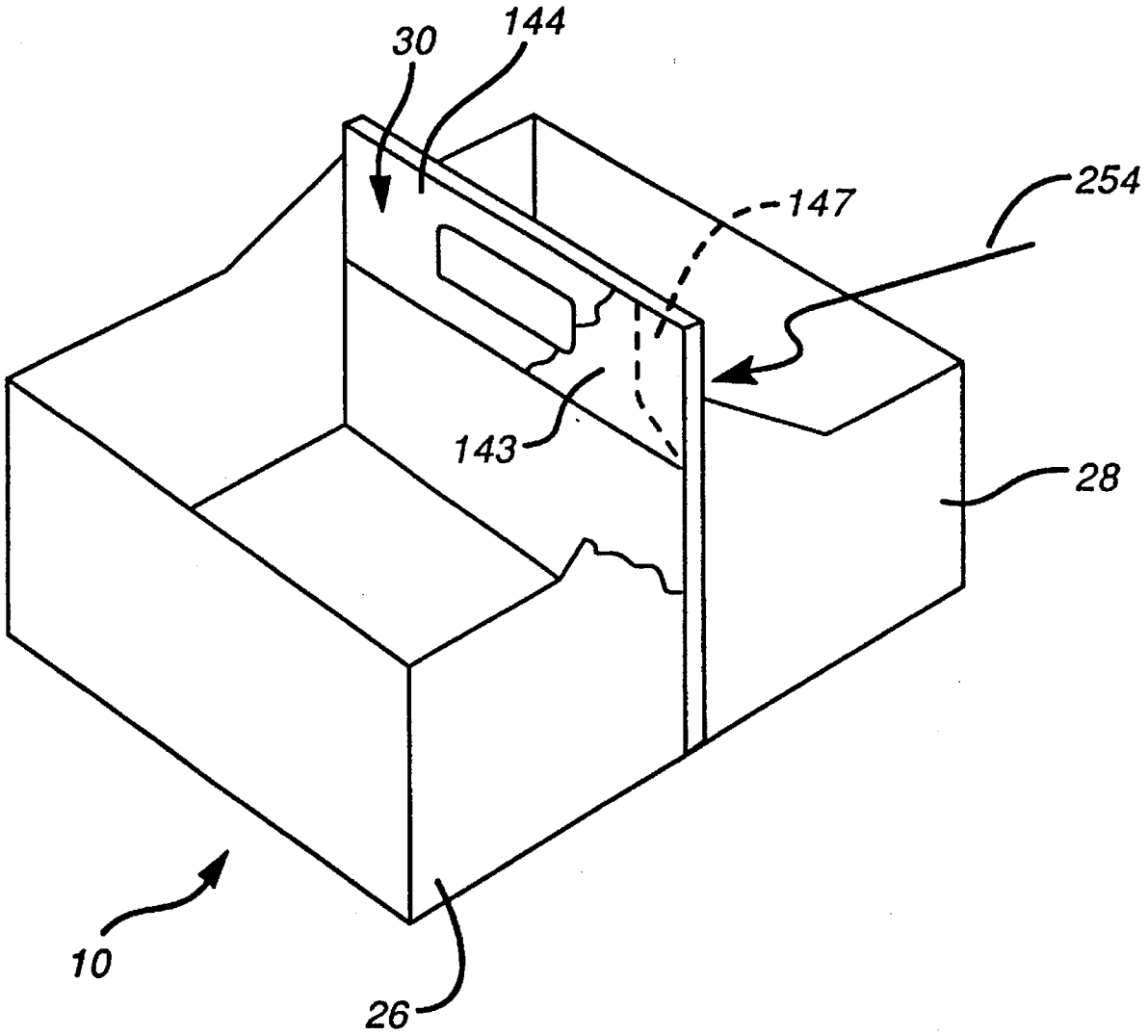
FIG. 10 is a view similar to FIG. 9 showing a portion of the handle and carrier side wall broken away.

The operation of the reinforcing tabs may be seen by reference to FIGS. 9 and 10, in which an erected carrier 10 is shown from which the bottles and partition structure has been removed for purposes of illustration.

In a carrier 10 which is loaded with bottles, the weight of the bottles imparts stresses into the structure extending from each side of the medial panel 30 which is downwardly and outwardly, illustrated in FIG. 9 by arrows 250 and 252. This places greatest stress on the carton at the point identified by arrow 254, since below this point, the fold line connecting medial panel 30 and side wall panel 26, and the fold line connecting medial panel 30 and side wall panel 28, provide a reinforcement. Similarly, above this point, the outer handle panels 144 and 148 (not shown) reinforce the edge of the medial panel. At the point identified by arrow 254, however, there is no reinforcement. The medial panel of an unreinforced carrier may have a tendency to tear along the lower edges of the outer handle panels 144 and/or 148, in the direction generally indicated by arrow 256.

Referring to FIG. 10, a portion of the carrier of FIG. 9 is shown, with various carrier panels broken away. It can be seen from FIG. 10 that the reinforcing tab 147 cooperates with handle reinforcement panel 143 to provide a reinforced, folded edge that extends along the edge of medial panel 30 both above and below the point indicated by arrow 254. As a result, any tendency to tear along arrow 256 is reduced.

Referring back to FIG. 2 and to the folding sequence depicted in FIGS. 2–6, it can be seen that the reinforcing structure adds nothing to the paperboard requirements of the carrier because the reinforcing tabs 147 and 157 are formed from a portion of the carrier blank which would otherwise be removed as scrap. Similarly, the tabs add little to the manufacturing complexity of the carrier, since the tabs are automatically folded into overlapping arrangement with reinforcing panels 143 and 153 during the folding steps shown by FIGS. 3 and 4.

What is claimed is:

1. A carrier for a plurality of objects arranged in at least two rows, the carrier including a reinforced handle and comprising:

substantially parallel first and second side walls;

substantially parallel first and second end walls interconnecting said side walls;

a medial panel extending between and connected to said first and second end walls, said medial panel being disposed between and substantially parallel to said first and second side walls;

a primary bottom wall connected and extending between lower portions of said first and second side walls; and a handle for the carrier comprising:

a handle opening defined in said medial panel;

first and second outer handle panels foldably connected at a first end edge thereof to a side edge of said medial panel and extending across said medial panel;

first and second handle reinforcing panels foldably connected at a first end edge thereof to second end edges of said first and second outer handle panels, respectively, and extending across said medial panel; and first and second handle reinforcing tabs foldably connected at a first end edge thereof to second end edges of said first and second handle reinforcing panels, respectively.

2. A carrier as claimed in claim 1, wherein said first end edges of said outer handle panels and said first end edges of said reinforcing tabs are substantially coincident, and wherein said first end edges of said reinforcing tabs extend downwardly along said first side edge of said medial panel further than said first end edges of said outer handle panels.

3. A carrier as claimed in claim 1, wherein said first end edges of said outer handle panels and said second end edges of said handle reinforcing panels are substantially coincident, and wherein said second end edges of said handle reinforcing panels extend downwardly along said first side edge of said medial panel further than said first end edges of said outer handle panels.

4. A carrier as claimed in claim 1, wherein said first end edges of said reinforcing tabs and said second end edges of said handle reinforcing panels are connected respectively along a pair of reinforcing fold lines, said first end edges of said outer handle panels and said reinforcing fold lines are substantially coincident, and wherein said reinforcing fold lines extend downwardly along said first side edge of said medial panel further than said first end edges of said outer handle panels.

* * * * *